US007871301B1

(12) United States Patent
Yang

(10) Patent No.: US 7,871,301 B1
(45) Date of Patent: Jan. 18, 2011

(54) DECORATIVE LIGHT

(76) Inventor: Chen-Sheng Yang, No. 10, Lane 233, Lanchang Rd., Nanzih District, Kaohsiung (TW)

( * ) Notice: Subject to any disclaimer, the term of this patent is extended or adjusted under 35 U.S.C. 154(b) by 0 days.

(21) Appl. No.: 12/563,115

(22) Filed: Sep. 19, 2009

(51) Int. Cl.
*H01R 33/09* (2006.01)

(52) U.S. Cl. ..... 439/699.2; 439/222; 439/220

(58) Field of Classification Search ..... 439/699.2, 439/220, 222, 602, 356
See application file for complete search history.

(56) References Cited

U.S. PATENT DOCUMENTS 4,181,390 A * 1/1980 Aizawa ..... 439/375
5,008,588 A * 4/1991 Nakahara ..... 439/699.2
5,368,503 A * 11/1994 Savage, Jr. ..... 439/502
5,558,543 A * 9/1996 Takano et al. ..... 439/699.2
5,630,729 A * 5/1997 Francis ..... 439/548
5,634,823 A * 6/1997 Furuta et al. ..... 439/699.2
6,120,312 A * 9/2000 Shu ..... 439/356
6,774,549 B2 * 8/2004 Tsai et al. ..... 439/356
7,001,046 B2 * 2/2006 Kaga et al. ..... 362/294
7,575,362 B1 * 8/2009 Hsu ..... 439/699.2
2003/0142508 A1 * 7/2003 Lee ..... 362/555

* cited by examiner

*Primary Examiner*—Briggitte R Hammond
(74) *Attorney, Agent, or Firm*—Pai Patent & Trademark Law Firm; Chao-Chang David Pai

(57) ABSTRACT

A decorative light has two conductors mounted in a casing. Two terminals of a bulb are positioned by electrical connectors of the conductors, and the terminals electrically connect with the electrical connectors. The bulb is positioned in the casing without a light seat, so number of elements is decreased. The terminals of the bulb are inserted and positioned by the electrical connectors, so cutting and bending of the terminals is not required and an efficiency of fabrication is increased.

3 Claims, 11 Drawing Sheets

DECORATIVE LIGHT

BACKGROUND OF THE INVENTION

1. Field of the Invention

The present invention relates to a light, and more particularly to a decorative light that is easily fabricated without cutting and bending of bulb terminals.

2. Description of Related Art

With reference to FIGS. 10 and 11, a conventional decorative light has a casing (50), two conductors (60), a light seat (70) and a bulb (80). The casing (50) has an inner surface (501). The conductors (60) are mounted oppositely on the inner surface (501) of the casing (50), and each conductor (60) has a clamp (61) for clamping a wire. The light seat (70) is mounted in the casing (50) and has a light mount (71), two holes (72), a bottom (73) and an outer surface (74). Each hole (72) is formed through the casing (50) from the light mount (71) to the bottom (73) of the light seat (70). The bulb (80) is mounted in the light seat (70) and has two terminals (81). The terminals (81) are mounted respectively in the holes (72), bent to abut the outer surface (74) of the light seat (70) and respectively contact the conductors (60).

When the conventional decorative light is fabricated, the terminals (81) have to be cut to a proper length and bent to abut the outer surface (74) of the light seat (70). The cutting and bending processes of the terminals (81) are inconvenient and decrease an efficiency of fabrication, and a person is easily poked and injured by terminals during cutting and bending of terminals. To overcome the shortcomings, the present invention provides a decorative light to mitigate the aforementioned problems.

SUMMARY OF THE INVENTION

An objective of the invention is to provide a decorative light that has a simplified structure and is easily fabricated without cutting and bending of bulb terminals.

The decorative light has two conductors mounted in a casing. Two terminals of a bulb are positioned by electrical connectors of the conductors, and the terminals electrically connect with the electrical connectors. The bulb is positioned in the casing without a light seat, so number of elements is decreased. The terminals of the bulb are inserted and positioned by the electrical connectors, so cutting and bending of the terminals is not required and an efficiency of fabrication is increased.

Other objectives, advantages and novel features of the invention will become more apparent from the following detailed description when taken in conjunction with the accompanying drawings.

DETAILED DESCRIPTION OF PREFERRED EMBODIMENT

Figure 1:
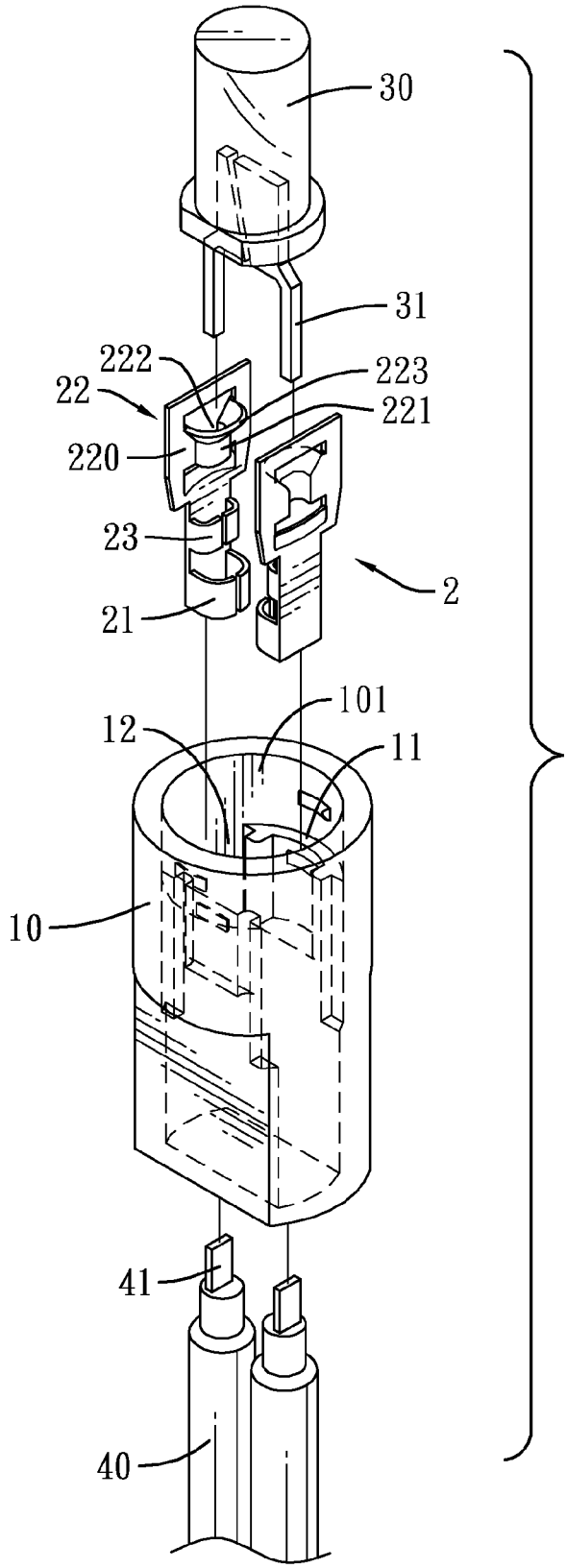
FIG. 1 is an exploded perspective view of a first embodiment of a decorative light in accordance with the present invention with wires.
Figure 2:
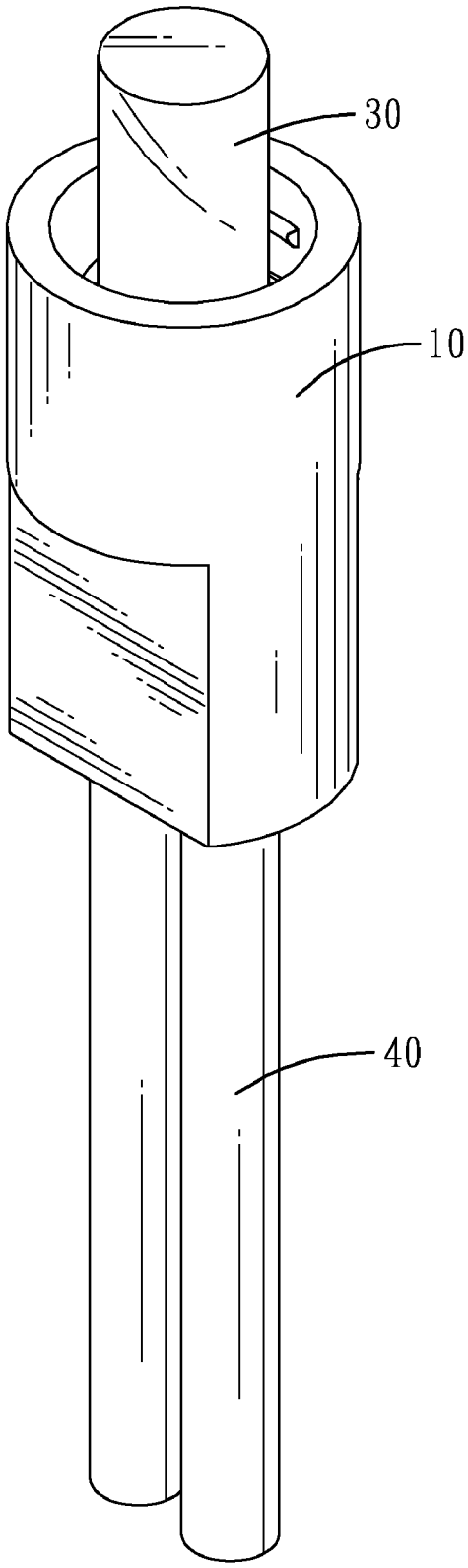
FIG. 2 is a perspective view of the decorative light with wires in FIG. 1.
Figure 3:
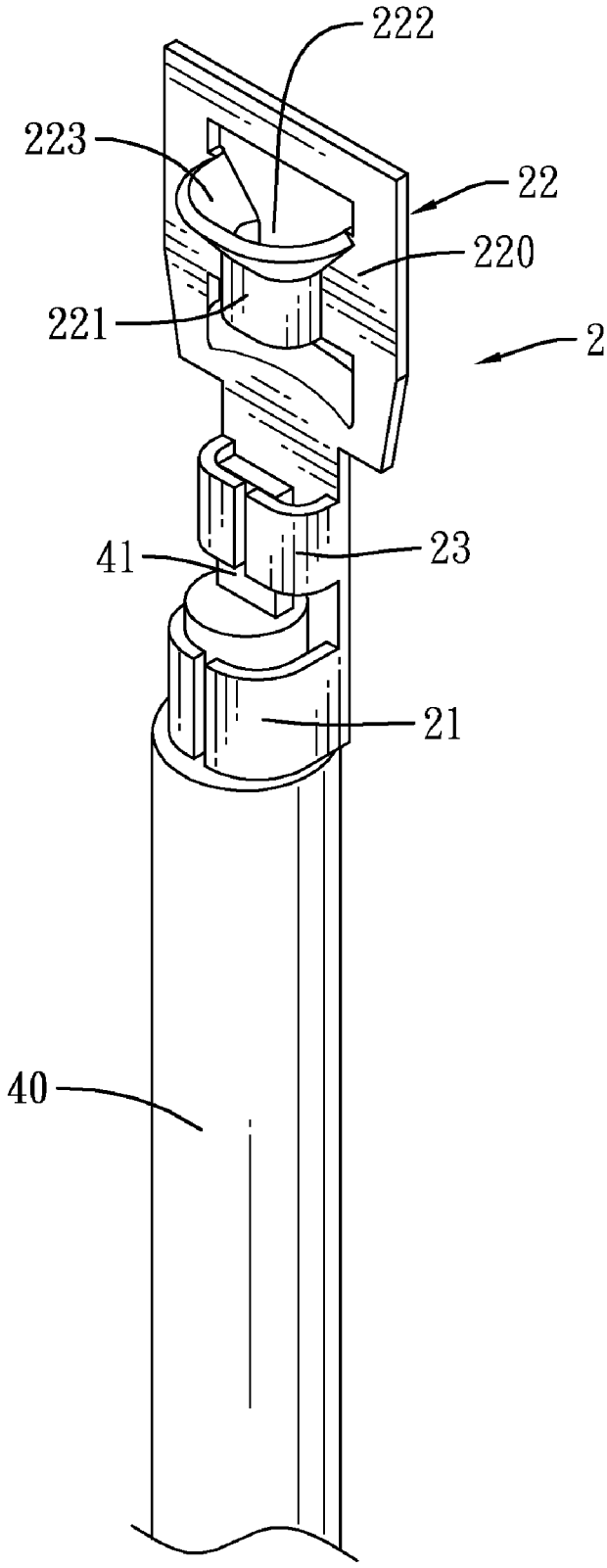
FIG. 3 is a perspective view of the conductor of the decorative light in FIG. 1 connected with a wire.
Figure 4:
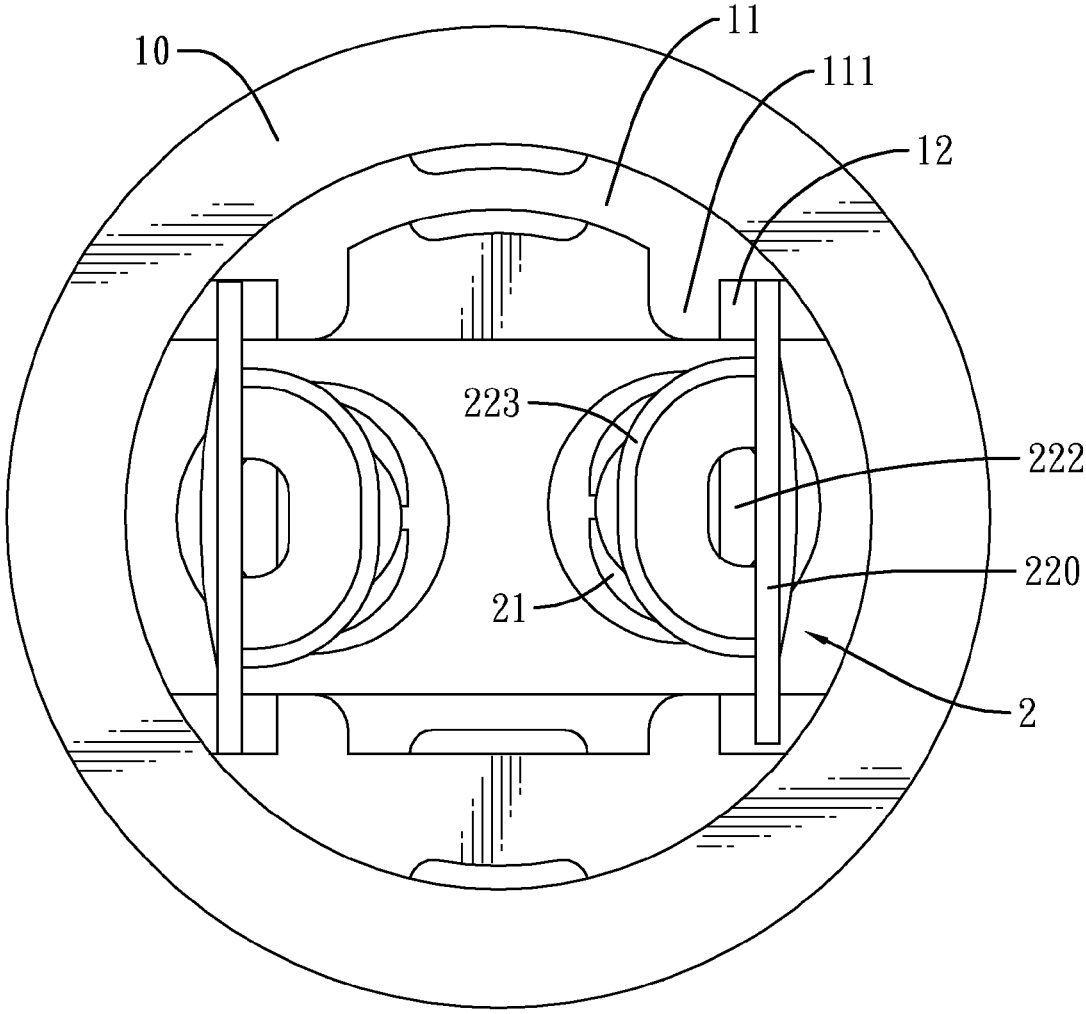
FIG. 4 is a top view of the conductors mounted in the casing of the decorative light in FIG. 1.
Figure 5:
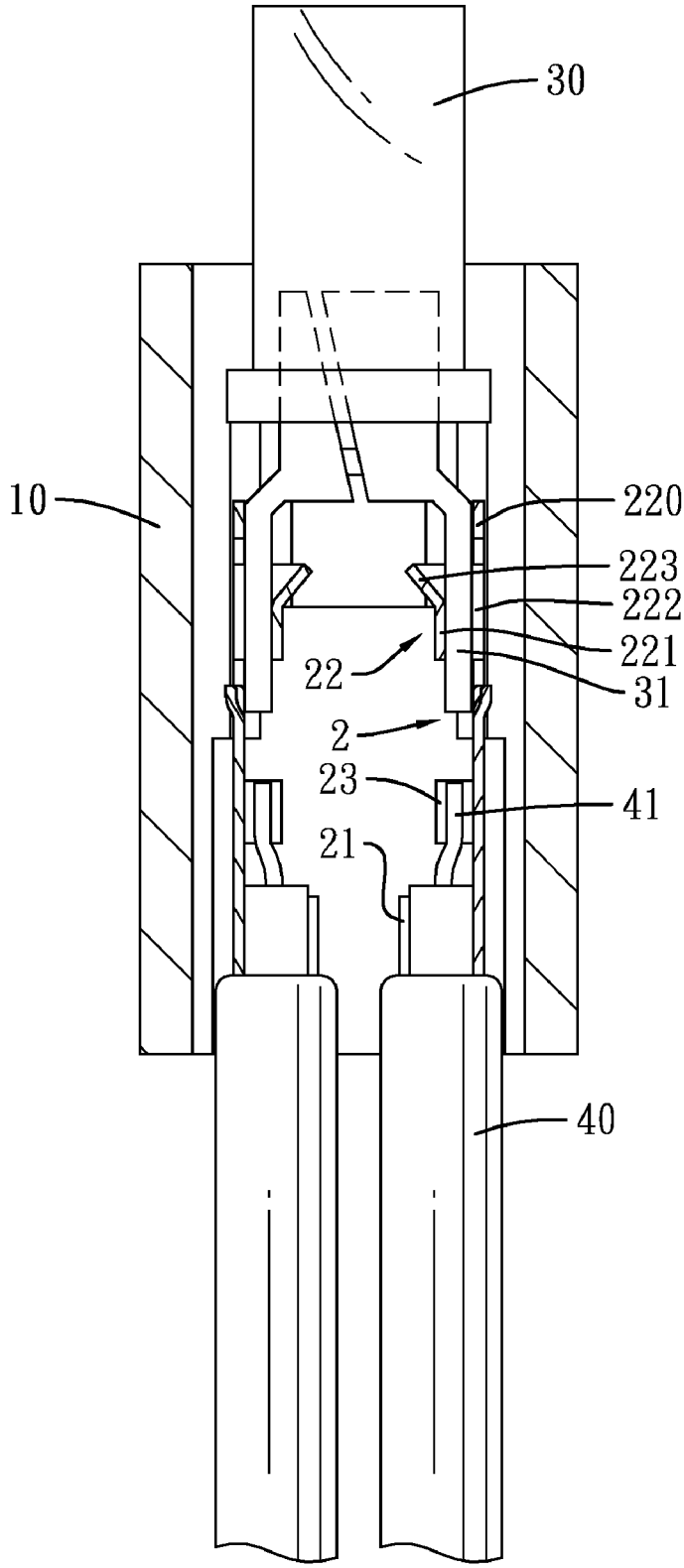
FIG. 5 is a side view in partial section of the decorative light in FIG. 1.
Figure 6:
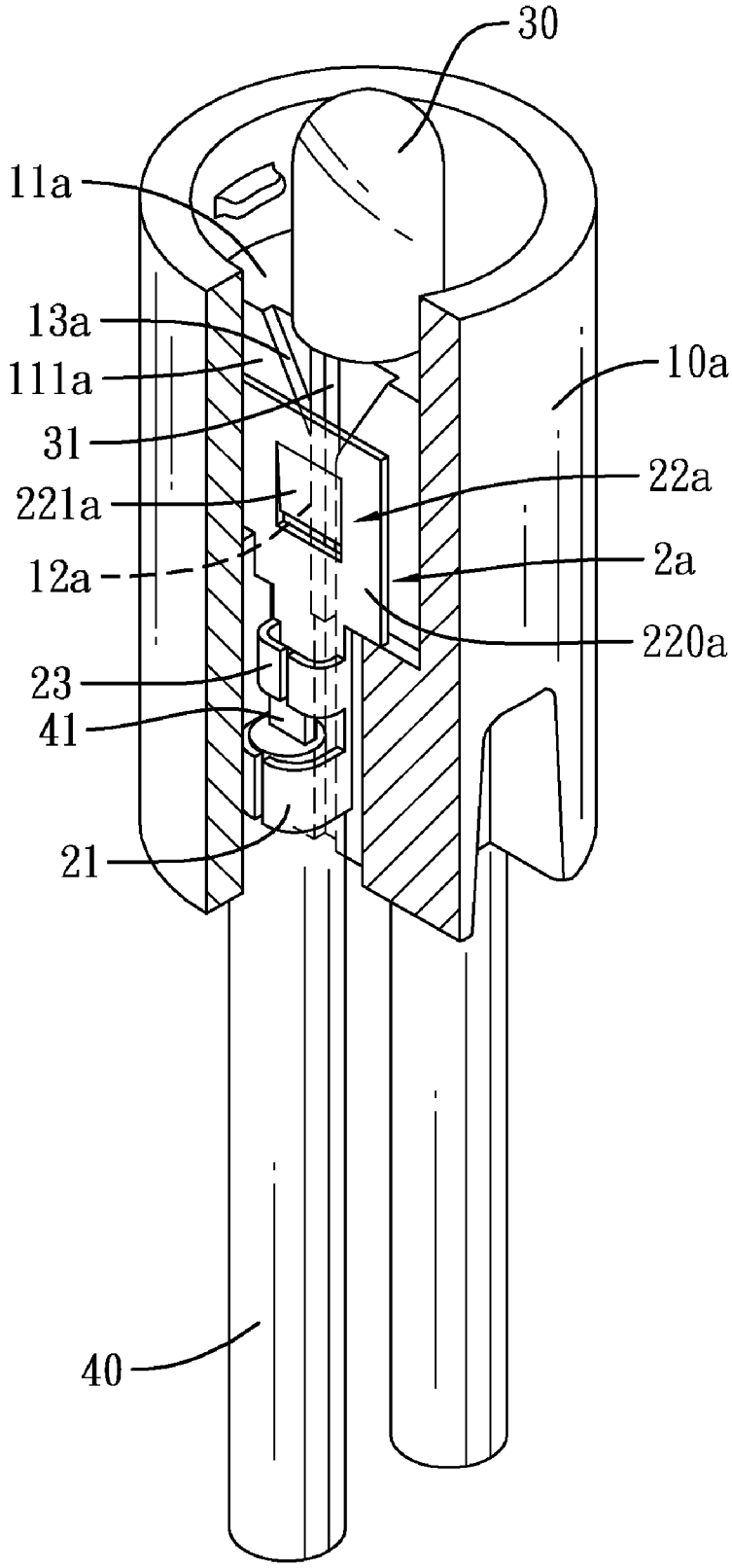
FIG. 6 is a perspective view in partial section of a second embodiment of a decorative light in accordance with the present invention connected with wires.
Figure 7:
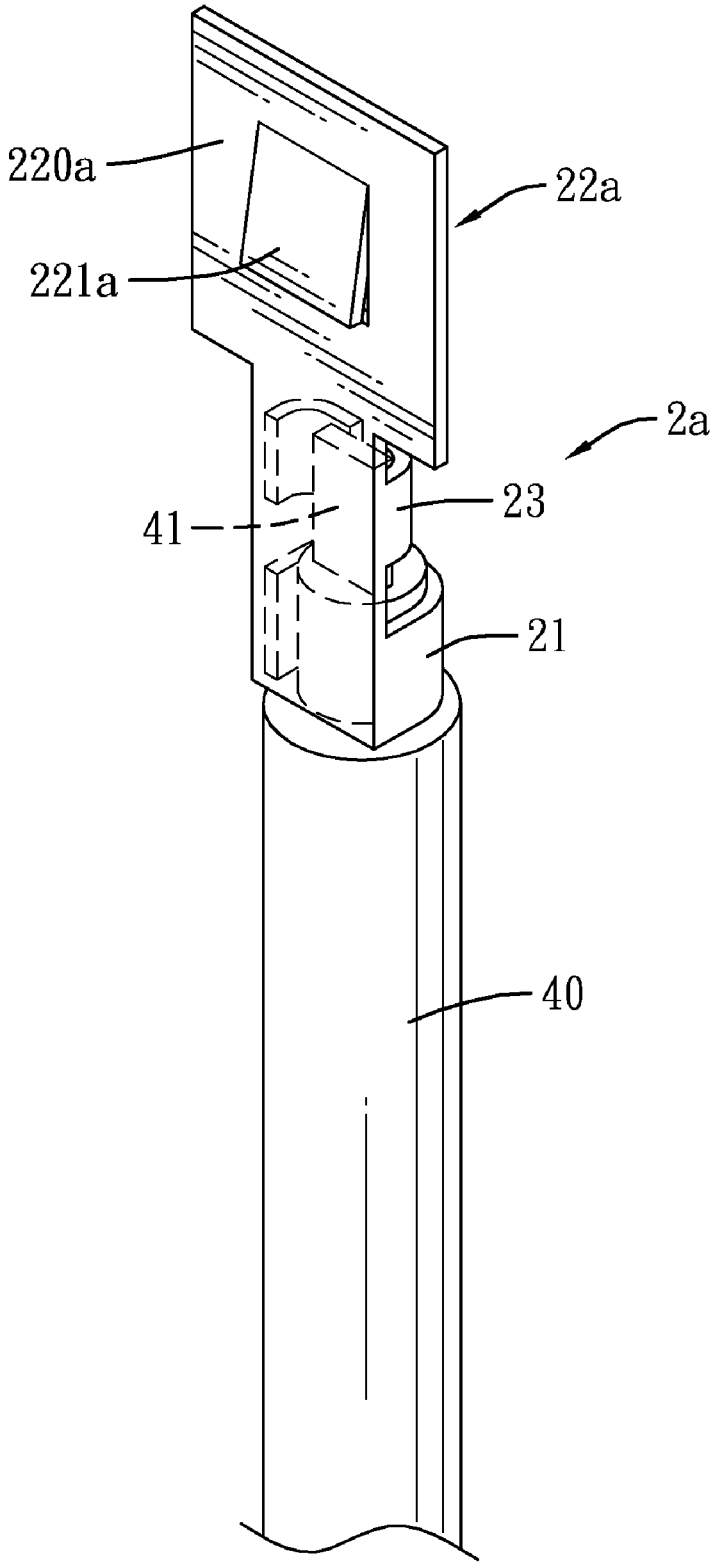
FIG. 7 is a perspective view of the conductor of the decorative light in FIG. 6 connected with a wire.
Figure 8:
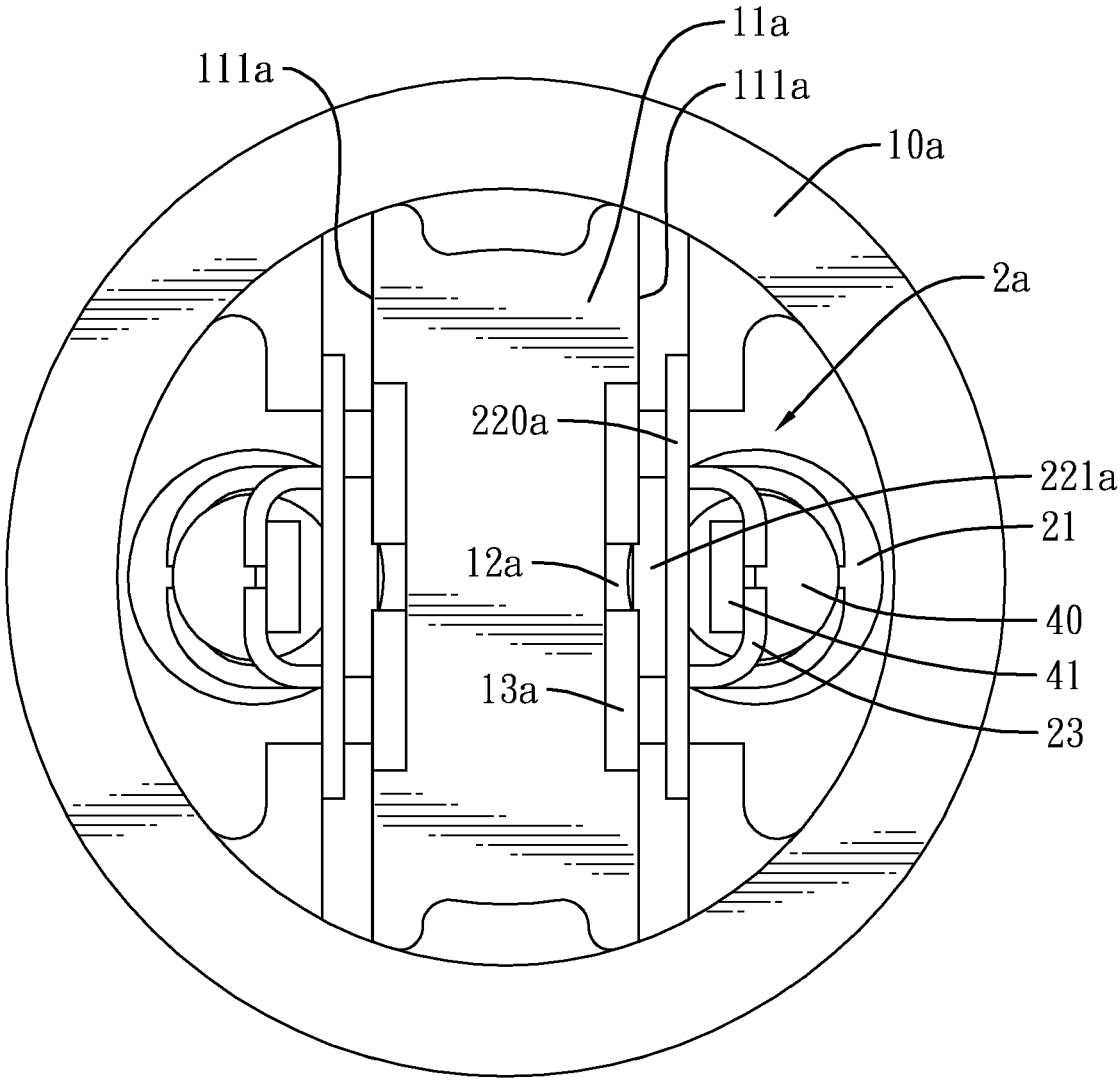
FIG. 8 is a top view of the conductors mounted in the casing of the decorative light in FIG. 6.
Figure 9:
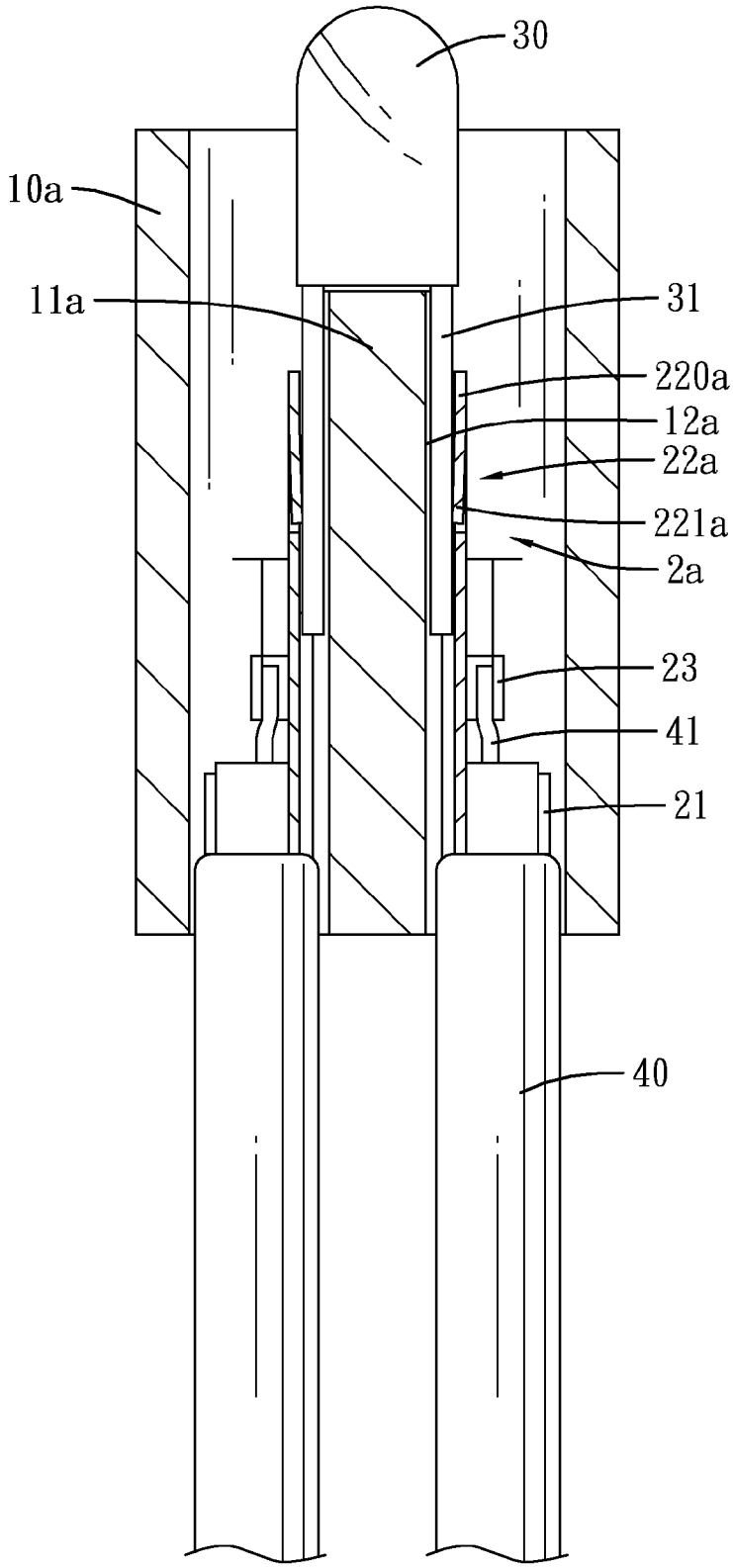
FIG. 9 is a side view in partial section of the decorative light in FIG. 6.
Figure 10:
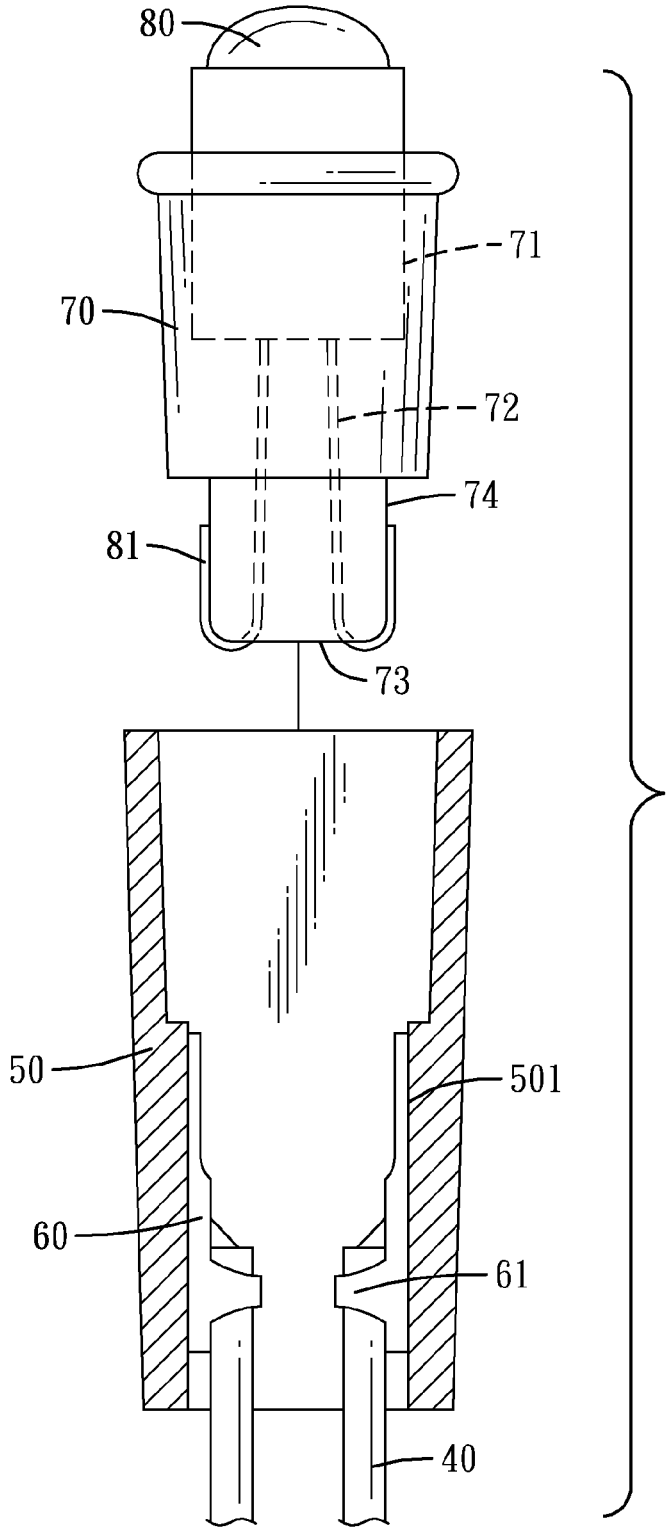
FIG. 10 PRIOR ART
FIG. 10 is an exploded side view in partial section of a conventional decorative light in accordance with the prior art connected with wires.
Figure 11:
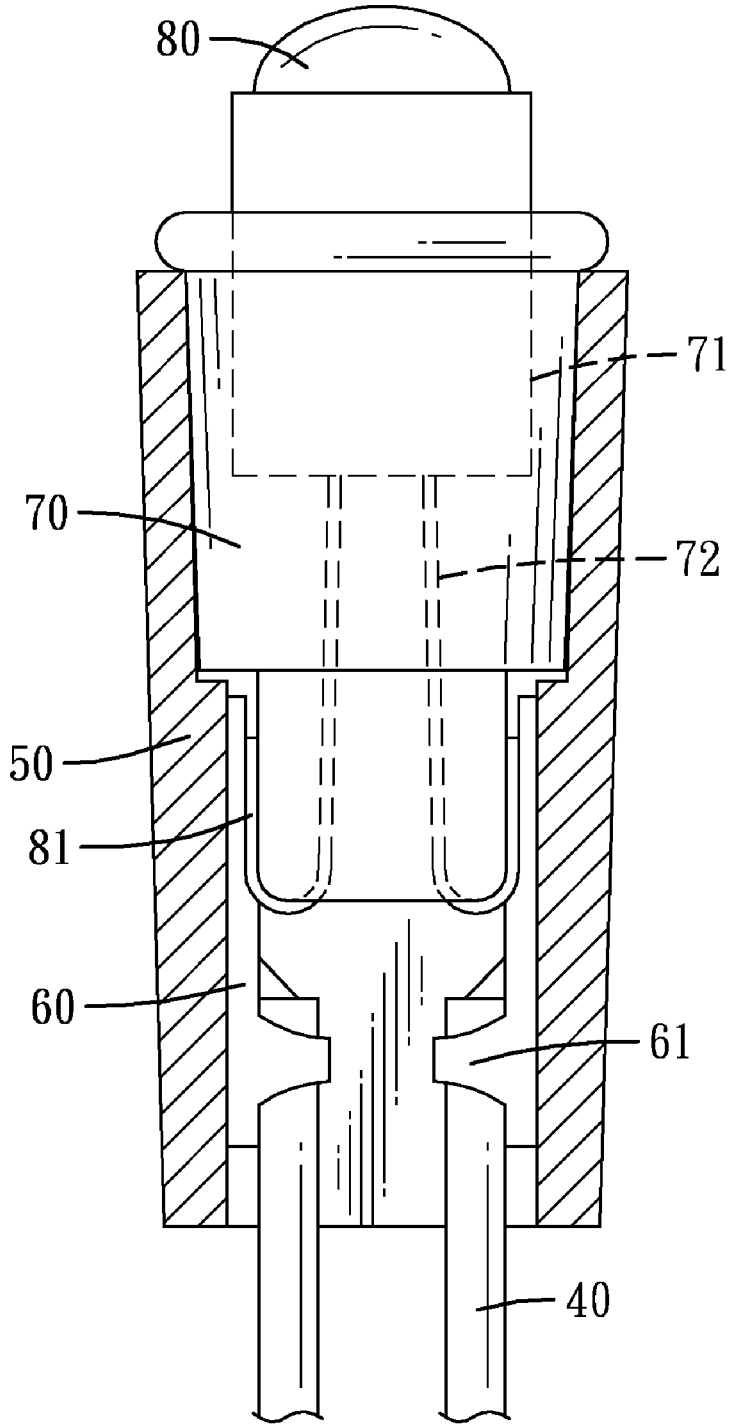
FIG. 11 PRIOR ART
FIG. 11 is a side view in partial section of the conventional decorative light in FIG. 10.

With reference to FIGS. 1 and 6, a decorative light in accordance with the present invention comprises a casing (10,10*a*), two conductors (2,2*a*) and a bulb (30). Each conductor (2,2*a*) has an electrical connector (22,22*a*), a wire clamp (21) and an optional core clamp (23). The wire clamp (21) is connected to a bottom end of the electrical connector (22,22*a*), and the core clamp (23) is formed between the electrical connector (22) and the wire clamp (21). The bulb (30) has two terminals (31).

With reference to FIGS. 1 to 5, in the first preferred embodiment in accordance with the present invention, the casing (10) has an inner surface (101), two protrusions (11) and two conductor mounts (12). The protrusions (11) are formed oppositely on the inner surface (101) of the casing (10). Each conductor mount (12) is formed on the inner surface (101) of the casing (10) between the protrusions (11).

The conductors (2) are mounted respectively in the conductor mounts (12). The electrical connector (22) of each conductor (2) has a body (220), a positioning tab (221), a holding space (222) and an optional tapered guide (223). The positioning tab (221) is formed on the body (220), and the holding space (222) is formed between the body (220) and the positioning tab (221). The tapered guide (223) is formed on and protrudes from a top of the positioning tab (221).

The bulb (30) is mounted in the casing (10). The terminals (31) are mounted respectively in the holding spaces (222), and each terminal (31) is clamped by the body (220) and the positioning tab (221) of the corresponding conductor (2).

With reference to FIGS. 6 to 9, in the second preferred embodiment in accordance with the present invention, the casing (10*a*) has a medium seat (11*a*) formed therein, and the medium seat (11*a*) has two opposite surfaces (111*a*), two optional holding spaces (12*a*) and two optional tapered guides (13*a*). The holding spaces (12*a*) are formed in the opposite surfaces (111*a*), respectively, and the tapered guides (13*a*) are formed above the holding spaces (12*a*) on the opposite surfaces (111*a*), respectively.

The two conductors (2*a*) are mounted beside the two opposite surfaces (111*a*), respectively. The electrical connector (22*a*) of each conductor (2*a*) has a body (220*a*) and a resilient sheet (221*a*) formed on the body (220*a*). The bulb (30) is mounted on the medium seat (11*a*) in the casing (10*a*) and the terminals (31) are mounted respectively in the holding spaces (12*a*). The terminals (31) are clamped between the medium seat (11*a*) and the resilient sheet (221*a*) of the conductors (2*a*), respectively.

When the decorative light in accordance with the present invention is fabricated, the terminals (31) of the bulb (30) only have to be inserted into the corresponding holding spaces (222,12*a*) and clamped and positioned by the electrical connectors (22,22*a*) to make the terminals (31) contact with the conductors (2). Accordingly, cutting and bending the terminals (31) is unnecessary during fabrication so an efficiency of fabrication is increased. Therefore, a person can be prevented from being injured during fabrication, and safety of fabrication is improved. In addition, the tapered guides (223,13*a*) can make the inserting process easily. The core clamps (23) can clamp and hold a core (41) of the wire (40) to make the conductors (2) always electrically conducting with the cores (41).

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A decorative light comprising:

a casing having an inner surface, two protrusions formed oppositely on the inner surface, and two conductor mounts formed on the inner surface and between the two protrusions;

two conductors mounted respectively in the conductor mounts of the casing, each conductor having an electrical connector and a wire clamp connected to a bottom end of the electrical connector, wherein each electrical connector has a body;

a positioning tab formed on the body; and a holding space formed between the positioning tab and the body; and a bulb mounted on the protrusions of the casing and having two terminals, wherein the terminals are respectively mounted in the holding spaces and each terminal is clamped between the positioning tab and the body of a corresponding conductor.

2. The decorative light as claimed in claim 1, wherein each electrical connector has a tapered guide formed on a top of the positioning tab.

3. The decorative light as claimed in claim 1, each conductor having a core clamp formed between the electrical connector and the wire clamp.

* * * * *